US009897372B2

(12) United States Patent
Daniel et al.

(10) Patent No.: US 9,897,372 B2
(45) Date of Patent: Feb. 20, 2018

(54) INTEGRATED LIGHTING SYSTEM FOR THE INTERIOR LINER OF AN APPLIANCE

(71) Applicant: Whirlpool Corporation, Benton Harbor, MI (US)

(72) Inventors: David E. Daniel, Kalamazoo, MI (US); Basavraj Ishwar Sankhgond, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 313 days.

(21) Appl. No.: 14/680,106

(22) Filed: Apr. 7, 2015

(65) Prior Publication Data

US 2016/0282038 A1 Sep. 29, 2016

Related U.S. Application Data

(60) Provisional application No. 62/136,709, filed on Mar. 23, 2015.

(51) Int. Cl.

| | |
|---|---|
| ***F25D 27/00*** | (2006.01) |
| ***F25D 23/04*** | (2006.01) |
| ***F21V 33/00*** | (2006.01) |
| *F21Y 113/13* | (2016.01) |

(52) U.S. Cl.

CPC ..... *F25D 27/005* (2013.01); *F21V 33/0044* (2013.01); *F25D 23/04* (2013.01); *F21Y 2113/13* (2016.08)

(58) Field of Classification Search

CPC ..... F21V 33/0044; F21W 2131/305; F25D 27/00; F25D 27/005; A47F 3/04; A47F 3/0404–3/0434

USPC ..... 362/92

See application file for complete search history.

(56) References Cited

U.S. PATENT DOCUMENTS

| | | | | |
|---|---|---|---|---|
| 7,000,407 | B2 | 2/2006 | Miozza et al. | |
| 7,320,528 | B2 | 1/2008 | Gotz | |
| 8,021,009 | B2 | 9/2011 | Knoll et al. | |
| 2007/0205705 | A1* | 9/2007 | Middleton | F25D 17/042 312/401 |
| 2008/0307818 | A1* | 12/2008 | Min | F25D 11/02 62/264 |
| 2010/0170279 | A1* | 7/2010 | Aoki | F25D 11/02 62/264 |

(Continued)

FOREIGN PATENT DOCUMENTS

| | | |
|---|---|---|
| KR | 100909465 | 7/2009 |

*Primary Examiner* — Sean Gramling
*Assistant Examiner* — Gerald J Sufleta, II
(74) *Attorney, Agent, or Firm* — Price Heneveld LLP

(57) ABSTRACT

An integrated lighting system for a kitchen appliance includes a refrigerated appliance having an appliance door that includes an inner door liner, an outer door wrapper and an insulation layer disposed within a cavity defined between the inner door liner and the outer door wrapper. The inner door liner defines a bin receptacle. A bin is selectively received by the bin receptacle. The bin receptacle includes a bin divider defined by the inner door liner and extends away from the outer door wrapper. The bin divider cooperates with the bin to define sub compartments of the bin. A lighting assembly is coupled to the bin divider, wherein the lighting assembly is configured to illuminate the bin and at least a portion of the interior compartment.

19 Claims, 6 Drawing Sheets

(56) References Cited

U.S. PATENT DOCUMENTS

| | | | | |
|---|---|---|---|---|
| 2012/0209763 | A1* | 8/2012 | Zabbatino | G06Q 30/0645 705/39 |
| 2013/0208447 | A1 | 8/2013 | Maslen | |
| 2013/0343036 | A1 | 12/2013 | Pelka | |
| 2014/0300265 | A1* | 10/2014 | Lee | F25D 29/00 312/405.1 |

* cited by examiner

INTEGRATED LIGHTING SYSTEM FOR THE INTERIOR LINER OF AN APPLIANCE

CROSS-REFERENCE TO RELATED APPLICATION

This application claims priority to and the benefit under 35 U.S.C. § 119(e) of U.S. Provisional Patent Application No. 62/136,709, filed on Mar. 23, 2015, entitled "INTEGRATED LIGHTING SYSTEM FOR THE INTERIOR LINER OF AN APPLIANCE," the entire disclosure of which is hereby incorporated herein by reference.

FIELD OF THE INVENTION

The device is in the field of lighting systems for kitchen appliances, more specifically, a lighting system for a kitchen appliance that is integrated within the interior liner of the appliance.

BRIEF SUMMARY OF THE INVENTION

According to at least one aspect, an integrated lighting system for a kitchen appliance includes a refrigerated appliance having a cabinet structure including a plurality of sidewalls and a back wall that define an interior compartment. An appliance door is coupled to the cabinet structure and is operable between open and closed positions. The appliance door includes an inner door liner, an outer door wrapper and an insulation layer disposed within a cavity defined between the inner door liner and the outer door wrapper. The inner door liner has a compartment surface that defines at least one bin receptacle. The compartment surface further defines the interior compartment when the appliance door is in the closed position. A bin is selectively received by a corresponding bin receptacle of the at least one bin receptacle, the corresponding bin receptacle including a bin divider defined by the inner door liner and extending away from the outer door wrapper. The bin divider cooperates with the bin to define sub compartments of the bin when the bin is coupled to the corresponding bin receptacle. A lighting assembly is coupled to the bin divider and is typically configured to selectively illuminate the bin when received by the corresponding bin receptacle and at least a portion of the interior compartment at least when the appliance door is in the open position.

According to at least another aspect, an integrated lighting system for an appliance door includes an inner door liner, an outer door wrapper coupled to the inner door liner to define a cavity, and an insulation layer disposed therein. A bin is selectively received by a corresponding bin receptacle. The corresponding bin receptacle includes a medial bin divider defined by the inner door liner and extends away from the outer door wrapper. The medial bin divider cooperates with the bin to define sub compartments of the bin when the bin is coupled to the corresponding bin receptacle. A lighting assembly is coupled to the medial bin divider and is typically configured to selectively deliver a predetermined illumination to at least a portion of the bin receptacle. A cover member supports the lighting assembly and includes a fastening portion that couples the lighting assembly to the inner door liner at the medial bin divider.

According to at least another aspect, an appliance includes a cabinet structure including a plurality of sidewalls and a back wall that define an interior compartment. An appliance door is operably coupled with the cabinet structure and operable between open and closed positions. The appliance door includes an inner door liner having a protrusion extending therefrom. The protrusion defines an interior volume. The door liner and the protrusion at least partially define the interior compartment when the appliance door is in the closed position. An outer door wrapper is coupled to the inner door liner to define a door cavity. The door cavity is in communication with the interior volume of the protrusion. An insulation layer is disposed within the door cavity. The insulation layer extends at least partially into the interior volume. A lighting assembly is coupled to the protrusion and is typically configured to selectively deliver a predetermined illumination to at least a portion of the door liner and at least a portion of the interior compartment. A cover member that supports the lighting assembly includes a fastening portion that couples the lighting assembly to the inner door liner at the protrusion.

These and other features, advantages, and objects of the present invention will be further understood and appreciated by those skilled in the art by reference to the following specification, claims, and appended drawings.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings, certain embodiment(s) which are presently preferred. It should be understood, however, that the invention is not limited to the precise arrangements and instrumentalities shown. Drawings are not necessary to scale. Certain features of the invention may be exaggerated in scale or shown in schematic form in the interest of clarity and conciseness.

DETAILED DESCRIPTION

Figure 1:
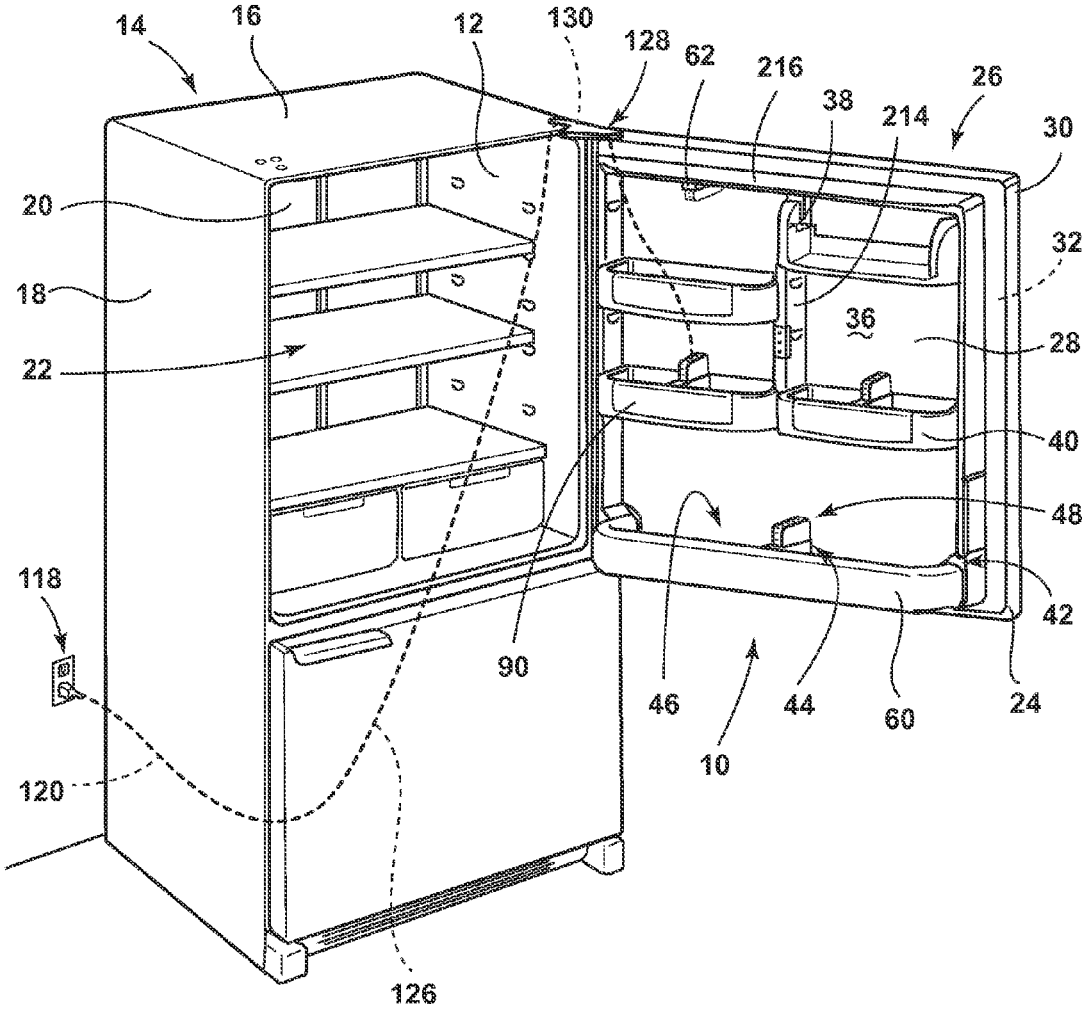
FIG. 1 is a top perspective view of an appliance incorporating an embodiment of the liner integrated lighting system.
Figure 2:
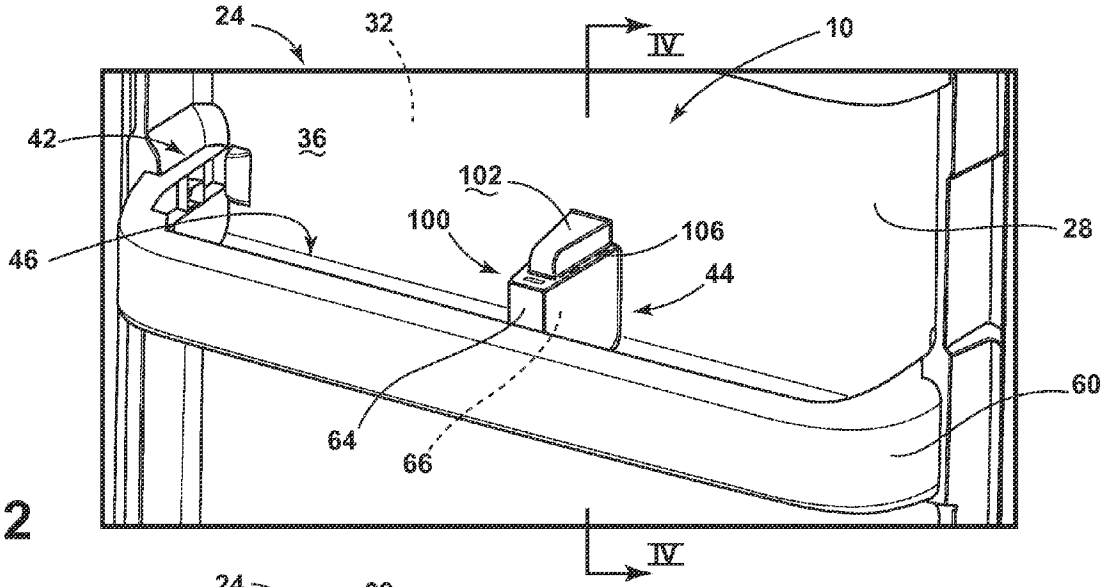
FIG. 2 is a top perspective view of an appliance door incorporating the liner integrated lighting system within a bin receptacle for the appliance door and the lighting assembly removed.
Figure 3:
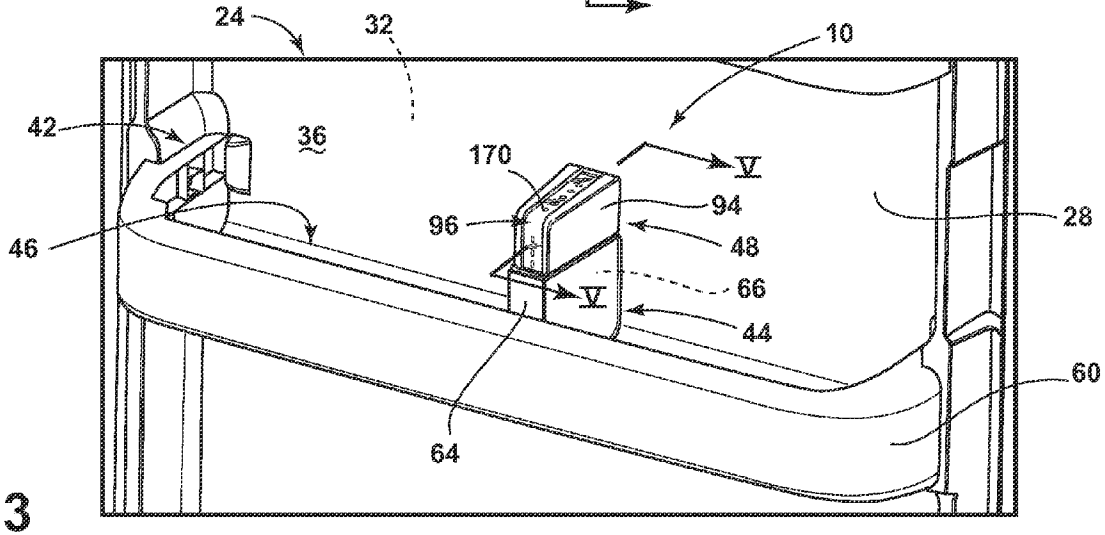
FIG. 3 is a top perspective view of the appliance door of FIG. 2 with the lighting assembly installed upon the medial bin divider.

Before the subject invention is described further, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

In this specification and the appended claims, the singular forms "a," "an" and "the" include plural reference unless the context clearly dictates otherwise.

As illustrated in FIGS. 1-10, reference numeral 10 generally refers to a liner integrated lighting system that is at least partially integrated within an interior liner 12 of a kitchen appliance, according to one embodiment. The liner integrated lighting system 10 for the kitchen appliance includes a refrigerated appliance 14 having a cabinet structure 16 that includes a plurality of sidewalls 18 and a back wall 20 that cooperate to define an interior compartment 22. An appliance door 24 is coupled to the cabinet structure 16 and operable between an open position 26 and a closed position. The appliance door 24 includes an inner door liner 28, an outer door wrapper 30 and an insulation layer 32 that is disposed within a cavity 34 defined between the inner door liner 28 and the outer door wrapper 30. The inner door liner 28 includes a compartment surface 36 that defines at least one bin receptacle 38. The compartment surface 36 further defines the interior compartment 22 when the appliance door 24 is in the closed position (not shown). A bin 40 is selectively received by a corresponding bin receptacle 42 of the at least one bin receptacle 38, the corresponding bin receptacle 42 includes a bin divider 44 defined by the inner door liner 28, where the bin divider 44 extends in a direction away from the outer door wrapper 30. The bin divider 44 cooperates with the bin 40 to define sub compartments 46 of the bin 40 when the bin 40 is coupled to the corresponding bin receptacle 42. A lighting assembly 48 is coupled to the medial bin divider 44 where the lighting assembly 48 is configured to selectively illuminate the bin 40 when the bin 40 is received by the corresponding bin receptacle 42, and also illuminate at least a portion of the interior compartment 22 at least when the appliance door 24 is in the open position 26.

The bin divider 44 may be located at a medial location and thus will be referred to herein as a medial bin divider 44, but could conceivably be positioned to one side or the other of a bin 40 or the bin receptacle 42. The location would typically be a predetermined location at the time of manufacture due to, at least, the powering considerations, but conceivably a self-powered or inductive charging system could be employed to allow user location selectability within the bin 40 and/or the bin receptacle 42.

It is contemplated that, while a top-mount single-door refrigerator is shown in the figures, the liner integrated lighting system 10 can be incorporated into a wide range of appliances having varying configurations. Such appliances can include, but are not limited to, single-door refrigerators, multi-door refrigerators, freezers, coffin-type refrigerators, wine or other specific-purpose refrigerators, dishwashers, warmers, ovens, vent hoods, and other similar household appliances.

Referring again to FIGS. 1-3, the inner door liner 28 of the appliance door 24 can include a bin receptacle 38 extending substantially along the width of the inner door liner 28. In this manner, the bin 40 can be coupled to the bin receptacle 38 to define a full-width bin 60 that extends substantially across the full width of the appliance door 24. The medial bin divider 44 is incorporated into the bin receptacle 38 to subdivide the bin 40 into the smaller sub compartments 46. In this manner, the medial bin divider 44 can substantially prevent lateral shifting of items disposed within the bin 40.

Referring again to FIGS. 1-4, the medial bin divider 44 can be a protrusion 62 that includes an outer wall 64 that defines a divider inner volume 66. In the various embodiments, the insulation layer 32 disposed within the cavity 34 defined between the inner door liner 28 and outer door wrapper 30 can at least partially extend into the divider inner volume 66. In this manner, the medial bin divider 44 can be an insulated member. In addition to providing insulation, the insulation layer 32 that extends into the divider inner volume 66 can also provide additional structural integrity to the outer wall 64 that defines the medial bin divider 44.

Figure 4:
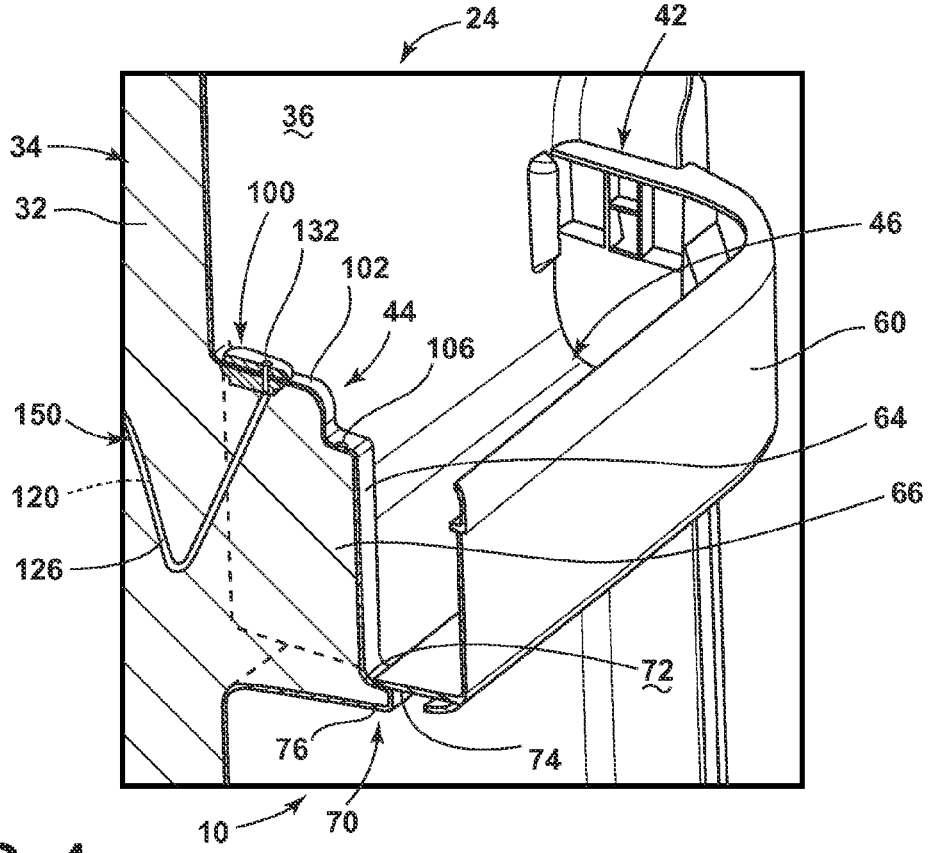
FIG. 4 is a cross-sectional view of the bin and medial bin divider of FIG. 2 taken along line IV-IV.
Figure 5:
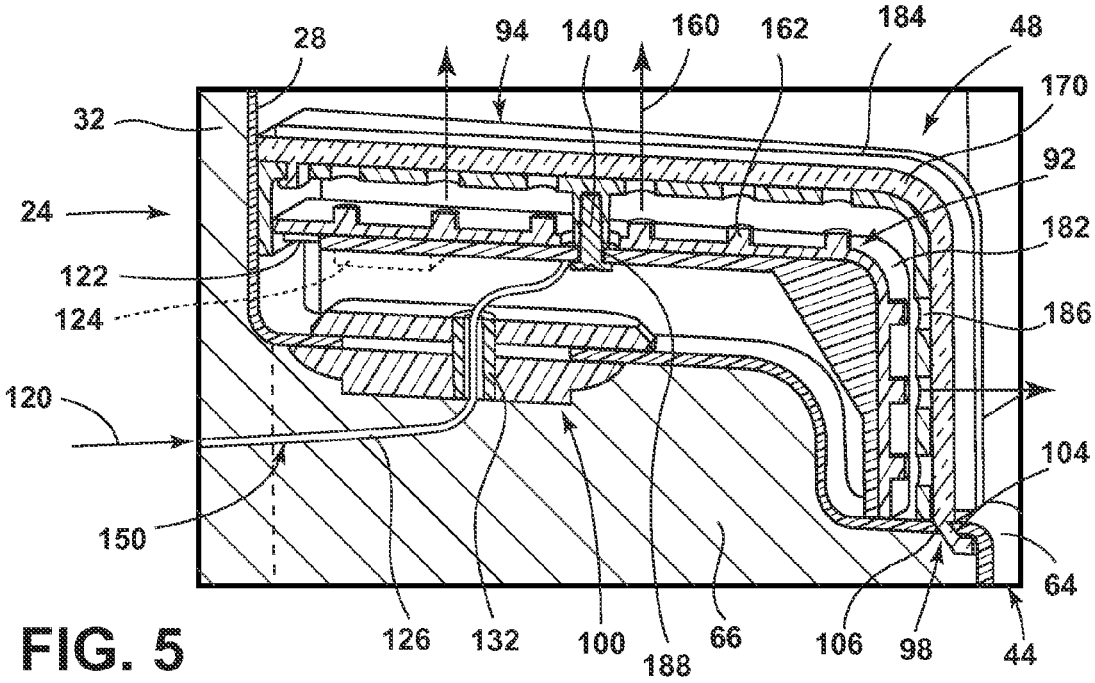
FIG. 5 is a cross-sectional view of the lighting assembly of FIG. 3, taken along line V-V.
Figure 6:
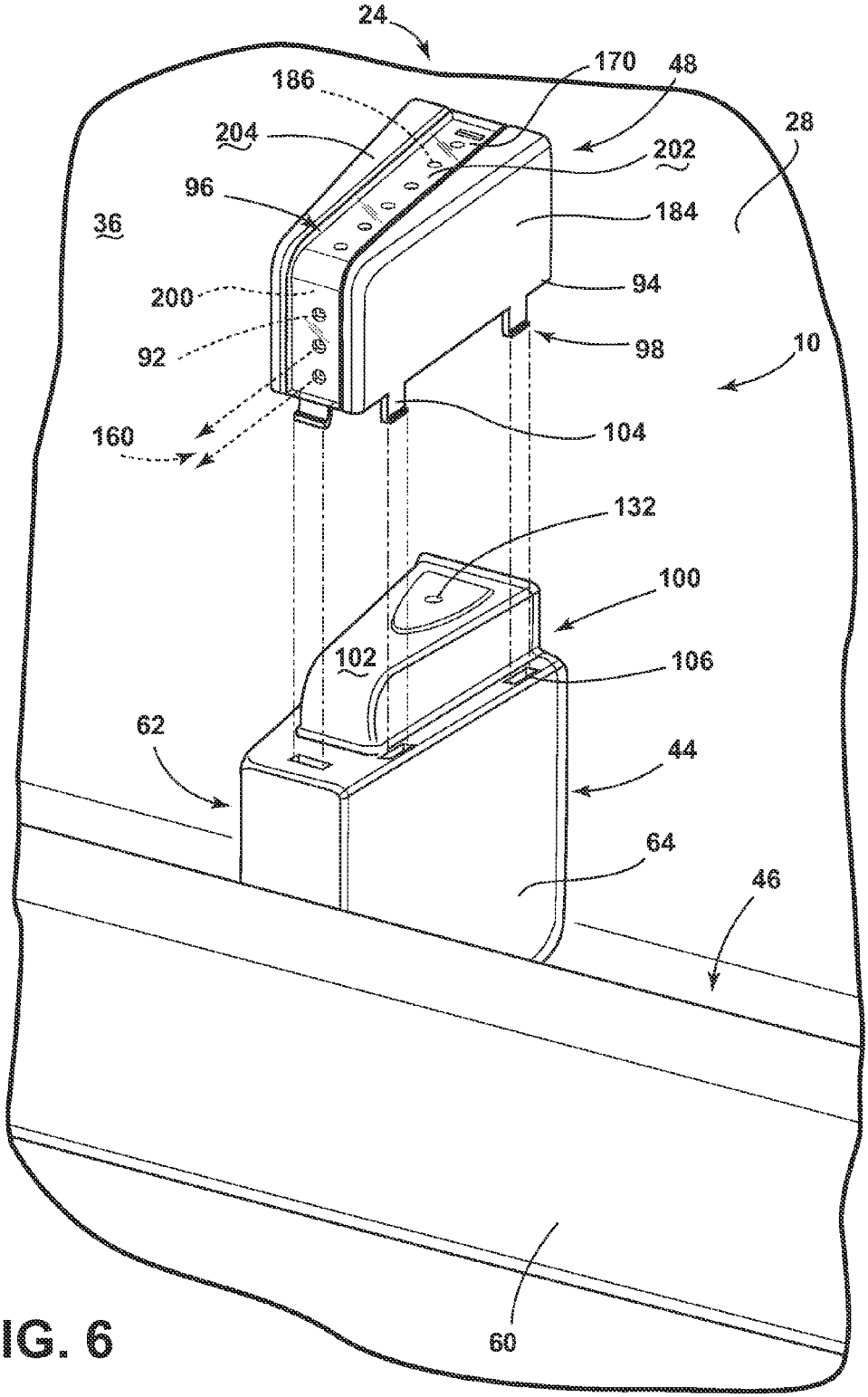
FIG. 6 is a partially exploded top perspective view of the liner integrated lighting assembly of FIG. 5, with the lighting assembly removed from the medial bin divider.
Figure 8:
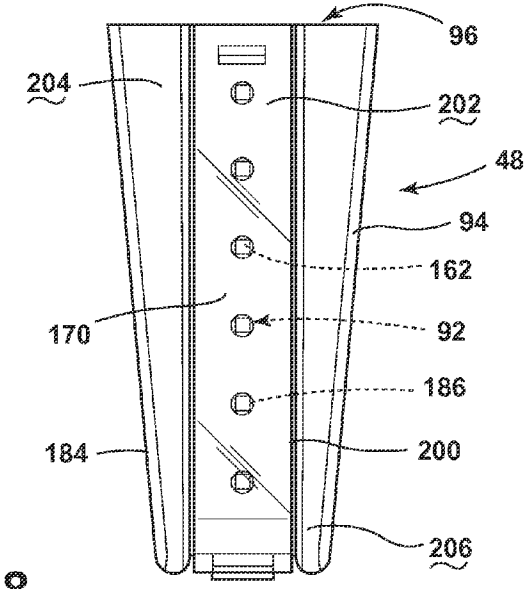
FIG. 8 is a top plan view of the lighting assembly of FIG. 7.
Figure 9:
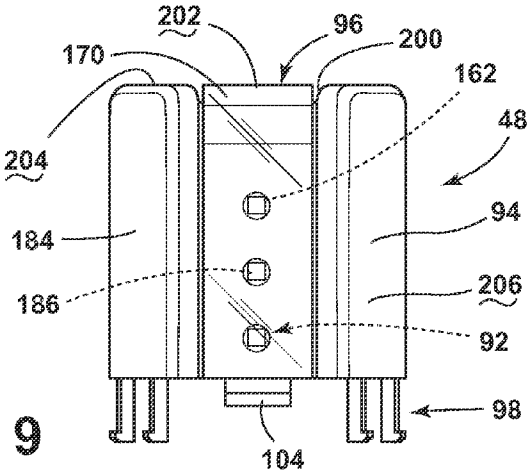
FIG. 9 is a front elevational view of the lighting assembly of FIG. 7.
Figure 7:
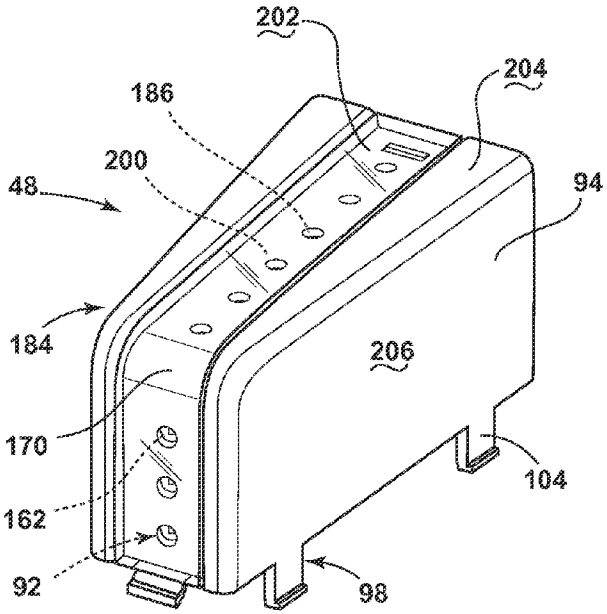
FIG. 7 is a top perspective view of an aspect of the lighting assembly of the liner integrated lighting system.
Figure 10:
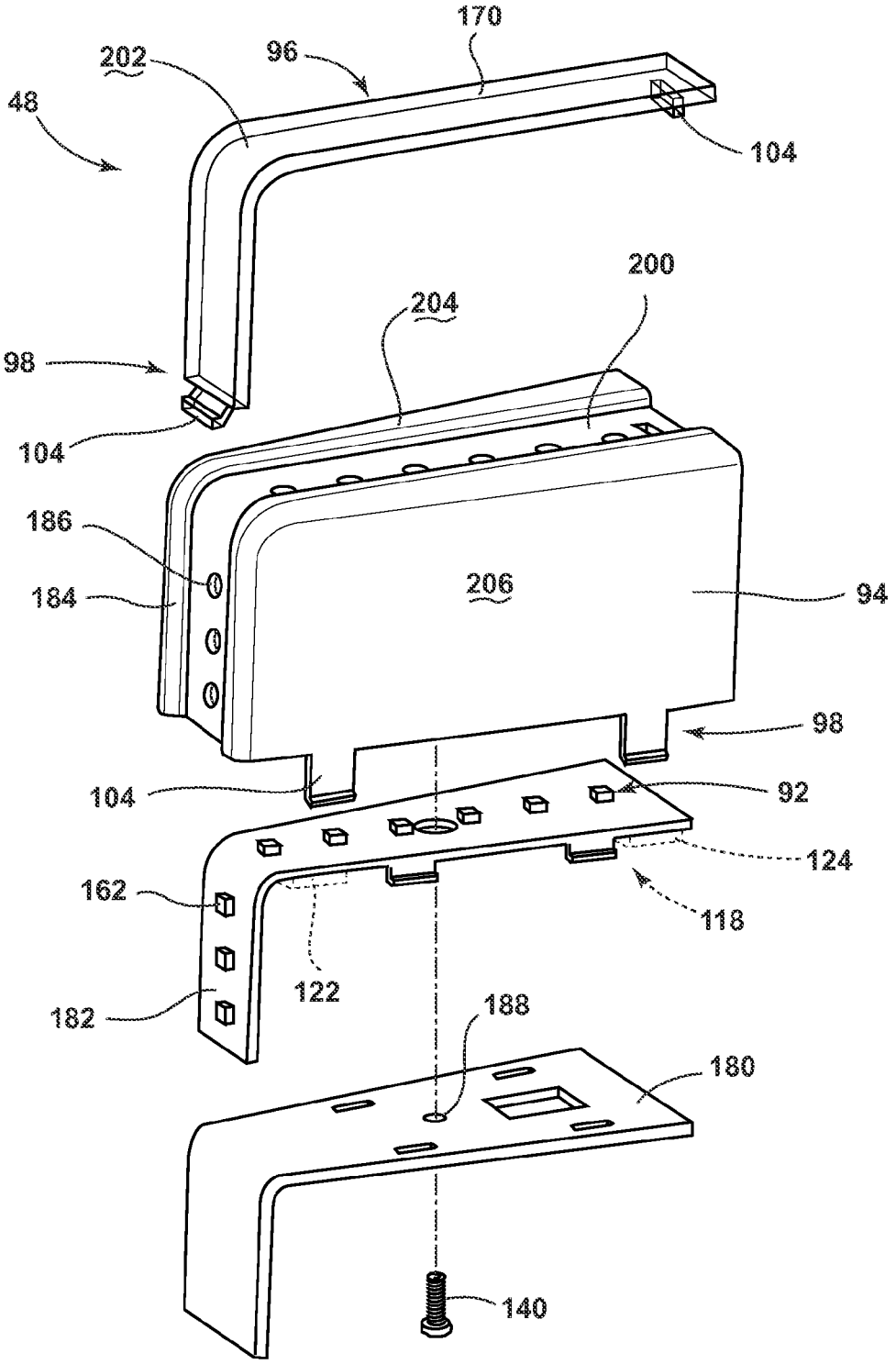
FIG. 10 is an exploded perspective view of the lighting assembly of FIG. 7.

Referring again to the embodiment illustrated in FIG. 4, the medial bin divider 44 can include a medial bin support 70 that extends outward from a portion of the medial bin divider 44. In this manner, the medial bin support 70 can extend at least partially under the bin 40 that can be disposed within one of the bin receptacles 38. The medial bin support 70 provides vertical structural support to the bin 40 disposed within the bin receptacle 38. This can be particularly useful where a bin 40 extends across the entire width of the inner door liner 28. Full-width bins 60 for refrigerated appliances 14 can, in various embodiments, tend to bow downward when various items are disposed within the full-width bin 60.

By way of example, and not limitation, where a gallon of milk or other substantially heavy refrigerated item is disposed within a full-width bin 60, the weight of the heavy refrigerated item can tend to cause the full-width bin 60 to deflect downward as a result of the weight of the refrigerated item. It is contemplated that the medial bin support 70 can provide a supporting surface 72 that receives a mid-point 74 of the full-width bin 60 and substantially prevents the deflection of the full-width bin 60 when the various refrigerated items are placed within the full-width bin 60. It is contemplated that the medial bin support 70 can include an outwardly extending flange 76 that extends under at least a portion of the full-width bin 60.

In various alternate embodiments, the medial bin support 70 can include a pair of flanges that extend outward from the medial bin divider 44, where the pair of flanges extend above and below a portion of the bin 40 and cooperatively position the mid-point 74 of the full-width bin 60 that is disposed within the bin receptacle 38. In such an embodiment, the pair of flanges that define the medial bin support 70 can cooperate to substantially prevent downward deflection and also substantially prevent twisting that may occur as the full-width bin 60 is loaded with refrigerated items.

According to the various embodiments, the medial bin divider 44 and the medial bin support 70 can include a thickened portion of the inner door liner 28 that is configured to receive downward and rotational forces from the full-width bin 60 disposed within the bin receptacle 38. It is also contemplated that the added structural support provided by the medial bin divider 44 and the medial bin support 70 can be implemented through the geometry of the medial bin divider 44 and the medial bin support 70, such that the inner door liner 28 having a consistent thickness can be formed to include the medial bin divider 44, without needing thickened portions, or substantially reinforced portions, to provide the structure of the medial bin divider 44 and the medial bin support 70.

Referring again to the embodiments illustrated in FIG. 1, it is contemplated that the bin divider 44 and the bin support 70, which are typically the medial bin divider 44 and the medial bin support 70, can be implemented in conjunction with the full-width bins 60, half-width bins 90, and other supporting positions within the various bin receptacles 38 defined by the inner door liner 28 of the appliance door 24. It is also contemplated that the bin divider 44 can be incorporated into portions of shelving positioned within the refrigerated appliance 14, where the bin divider 44 extends at least partially over the top surface 102 of a shelf, and the bin support 70 extends partially underneath the shelf to subdivide and also support the shelf from below, or other storage member disposed within the refrigerated appliance 14.

Referring again to the various embodiments illustrated in FIGS. 1-5, in addition to providing subdividing and support functionalities, the medial bin divider 44 can include the lighting assembly 48 for providing lighting to various portions of the refrigerated appliance 14. The lighting assembly 48 can include at least one light fixture 92 that is attached to and/or in communication with an outer shell 94. The outer shell 94 can be disposed over the at least one light fixture 92. The outer shell 94 may include an at least partially translucent portion 96 that is not opaque and that can be selectively illuminated when the at least one light fixture 92 is activated. The at least partially translucent portion 96 can include a member that can have a range of translucency from at least partially translucent, to partially transparent, to transparent.

The level of translucency or transparency defined within the at least partially translucent portion 96 is intended to deliver illumination from the light fixture 92, through a selected portion of the outer shell 92, and to various areas at least proximate the appliance 14. The level of translucency or transparency incorporated into the at least partially translucent portion 96 is used to provide a predetermined amount of light diffusion that can serve to incorporate any one or more of various lighting effects. Such effects can include, but are not limited to, a soft glow, a bright diffused light, patterned lighting, directed lighting, spot lighting, various throw ranges of lighting, combinations thereof, and other similar selectable lighting effects.

It is contemplated that the outer shell 94 can include a fastening portion 98 that selectively engages the outer wall 64 of the medial bin divider 44. In order to receive the lighting assembly 48, the medial bin divider 44 can include a lighting assembly receptacle 100 that can be disposed proximate a top surface 102 of the medial bin divider 44. The lighting assembly 48 can include one or more tabs 104 that extend downward from the outer shell 94 to engage tab receptacles 106 defined within the lighting assembly receptacle 100 of the medial bin divider 44.

Referring again to FIGS. 1-6, the lighting assembly 48 can be coupled to a power source 118 and a control 122 that is configured to deliver electrical current 120 from the power source 118 to the lighting assembly 48. The delivery of the electrical current 120 can be based upon a selective input that is delivered to the control 122. According to the various embodiments, the power source 118 for the lighting assembly 48 can be the same power source 118 that delivers electrical current 120 to the refrigerated appliance 14, such as a plug coupled to an electrical wall outlet for a residential structure. In addition, it is contemplated that the power source 118 for the lighting assembly 48 can be positioned locally, such as a battery 124 positioned within a portion of the lighting assembly 48 for providing electrical current 120 to the various light fixtures 92 disposed within the lighting assembly 48.

In embodiments where the power source 118 is disposed outside of the lighting assembly 48, such as the residential electrical outlet, the electrical current 120 can be delivered to the lighting assembly 48 through at least one wire 126 that is run through at least a portion of the cabinet structure 16. In such an embodiment, the appliance door 24 can include at least one hinge 128 that extends from the cabinet structure 16 to hingedly couple the appliance door 24 to the cabinet structure 16. Wiring for the lighting assembly 48 can be run through a hollow door hinge harness 130 that is disposed within the at least one hinge 128. It is contemplated that the at least one wire 126 can extend from the hollow door hinge harness 130 to a grommet 132 disposed within a portion of the medial bin divider 44. The grommet 132 can extend through at least a portion of the outer shell 94 of the medial bin divider 44. In the various embodiments, the grommet 132 can be positioned within a portion of the lighting assembly receptacle 100 such that when the lighting assembly 48 is attached to the lighting assembly receptacle 100 of the medial bin divider 44, the lighting assembly 48 can be connected to the at least one wire 126 proximate the grommet 132.

According to the various embodiments, the lighting assembly 48 can include one or more electrical contacts. An electrical contact may be a screw 140, that receives the at least one wire 126 extending from the grommet 132. In such an embodiment, the lighting assembly 48 can be hard wired prior to installation and subsequently attached to the lighting assembly receptacle 100, where the at least one wire 126 is attached to the lighting assembly 48 in a substantially permanent fashion. It is also contemplated that the lighting assembly 48 can include an electrical contact that engages a current-providing contact disposed proximate the grommet 132. In such an embodiment, the current-providing contact can be placed in electrical communication with the at least one wire 126 that extends through the cavity 34 and to the grommet 132, where the at least one wire 126 is connected to the current-providing contact. The current-providing contact then provides electrical current 120 to the lighting assembly 48 when the electrical contact of the lighting assembly 48 engages the current-providing contact of the medial bin divider 44 disposed proximate the grommet 132. In such an embodiment, the lighting assembly 48 can be conveniently removed, replaced, or otherwise manipulated without having to remove and reattach various wires 126 for providing electrical current 120 to the various light fixtures 92 of the lighting assembly 48.

Referring again to FIGS. 4-6, it is contemplated that the grommet 132 can provide lateral support for the wire 126 that extends through the appliance door 24 and provides power to the lighting assembly 48. The grommet 132 can substantially position and laterally secure the at least one wire 126 in a predetermined position 150 such that the wire 126 does not substantially move during operation of the refrigerated appliance 14, where such movement of the wire 126 can affect the integrity of the insulation layer 32 disposed within cavity 34 defined between the inner door liner 28 and the outer door wrapper 30. Accordingly, the grommet 132 can provide for manipulation of the lighting assembly 48 while keeping the wire 126 in the substantially fixed predetermined position 150.

Referring again to FIGS. 1-6, the control 122 that is configured to deliver electrical current 120 from the power source 118 to the lighting assembly 48 can be operated based on a passive or selective input that is delivered to the control 122. In this manner, the illumination 160 provided by the lighting assembly 48, which can include at least two lighting colors, can be selectively activated based upon the passive or selected input delivered to the control 122. It is contemplated that the input delivered to the control 122 can include various passive and active inputs that can include, but are not limited to, the temperature of an area disposed within the refrigerated appliance 14, the temperature of an area external of the refrigerated appliance 14, the time of day, a length of time that the appliance door 24 has been continuously opened, a system signal from a portion of the refrigerated appliance 14, the activation of a mechanical or electrical portion of the refrigerated appliance 14, a specific user input, a randomized color sequence, a predetermined color sequence, activation of a function of the refrigerated appliance 14 (such as dispensing water, dispensing ice, and other functions), movement of a portion of the refrigerated appliance 14 (such as a drawer, or other movable portion of the refrigerated appliance 14), movement sensors disposed within the appliance (such that the user reaching into various portions of the refrigerated appliance 14 can activate different illumination sequences of the lighting assembly 48), mood lighting based upon physiological input of the user (such as body temperature, heartrate, grip strength, speed of movement and others) and other various user inputs that may be received. Sources of user input may include portable personal computing devices that can include, but are not limited to, touch-sensitive tablets, personal computer display screens operably connected to a personal computer phone or other device such as a wearable computerized glasses or a computerized watch that includes physiological sensors for detecting any one or more various physical status characteristics, as described above, and transmitting this information, or an input based upon this information to the control 122. Where temperatures are used to deliver an input to the control 122, temperature sensors can be incorporated into the appliance 14.

Referring again to FIGS. 3-10, the plurality of light fixtures 92 of the lighting assembly 48 can be selectively operated, individually or in concert, to provide predetermined illumination 160 that includes at least two different visible wavelengths of illumination 160. It is also contemplated that the various light fixtures 92 of the lighting assembly 48 can include light emitting diode (LED) fixtures 162 that can be included within a circuit board positioned within a portion of the lighting assembly 48. According to the various embodiments, the LED fixtures 162 can be of a plurality of colors, such that the individual color of each LED can be activated to provide illumination 160 in the form of these predetermined colors. It is also contemplated that the LED fixtures 162 of varying colors can be activated in combination to provide light-based color mixing to various portions of the refrigerated appliance 14. Additionally, the intensity of the illumination 160 provided by the LED fixtures 162 can also be varied such that infinite color combinations can be provided to portions of the refrigerated appliance 14. In order to regulate the color combinations, the control 122 can selectively and independently regulate the flow of electrical current 120 to each of the LED fixtures 162 of the lighting assembly 48. As discussed above, the amount of electrical current 120 delivered to each LED fixture 162 can be controlled based upon the various passive and active inputs that are delivered to the control 122 from various portions of the refrigerated appliance 14 as well as areas outside of the refrigerated appliance 14.

Referring again to FIGS. 3-10, it is contemplated that the outer shell 94 of the lighting assembly 48 can include a transparent lens 170 that extends over at least a portion of the light fixtures 92 of the lighting assembly 48. According to the various embodiments, it is contemplated that the lens 170 of the lighting assembly 48 can include various surface conditions to provide varying lighting effects for the refrigerated appliance 14. Such surface conditions of the lens 170 can include, but are not limited to, clear, frosted, prismatic, tinting, etching and other similar surface conditions that can diffuse, deflect, refract, or otherwise manipulate the various patterns of illumination 160 delivered by the light fixtures 92 of the lighting assembly 48. In addition to these surface conditions, the lens 170 can include various indicia, such as logo patterns, that can be projected by the light fixtures 92 as the illumination 160 travels through the lens 170. In such an embodiment, various patterns, such as a company logo, monogram, phrase, graphic, or other image or indicia can be projected onto a nearby surface either within the refrigerated appliance 14 or external to the refrigerated appliance 14.

According to various embodiments, it is also contemplated that a pattern of LED lights can be implemented to convey various information through the lens 170 and which can be projected onto a surface either within the refrigerated appliance 14 or external to the refrigerated appliance 14. Such information can include, but is not limited to, a temperature of the refrigerated appliance 14, time, external temperature, other status information regarding the refrigerated appliance 14, miscellaneous information, various patterns, or other indicia that can be provided by a plurality of LEDs and projected through the lens 170 onto an area on or around the refrigerated appliance 14.

Referring again to FIGS. 3-10, the lighting assembly 48 can include a substrate member 180 that can serve as one of the primary structural formations of the lighting assembly 48. The various light fixtures 92 can be disposed upon the substrate member 180, where the various light fixtures 92 can include, but are not limited to, incandescent lights, halogen lights, fluorescent lights, LED lights, or other similar light fixtures 92. Where the light fixture 92 is one or more LED fixtures 162, each LED fixture 162 can be included within a printed circuit board 182 that can be disposed upon the substrate member 180. The printed circuit board 182 can include various circuitry, as well as the control 122, that can be used to operate the various patterns of illumination 160 of the lighting assembly 48. The printed circuit board 182 can also include a battery 124 or other independent power source 118 that can be used to provide electrical current 120 to the LED fixtures 162. A cover portion 184 of the outer shell 94 can be disposed over the printed circuit board 182, where the cover portion 184 includes a plurality of apertures 186 through which the LED fixtures 162 can provide illumination 160 for the lighting assembly 48. It is also contemplated that the substrate member 180 and the cover portion 184 can cooperate to form a fixing aperture 188 through which a fastener, such as the screw 140, can be extended to engage the cover portion 184 with the substrate member 180. In this manner, the printed circuit board 182 can be substantially securely positioned between the cover portion 184 and the substrate member 180, such as with the screw 140, to contain and substantially protect the printed circuit board 182 from damage, debris, and other potential harm.

Referring again to FIGS. 6-10, the cover portion 184 can include a channel 200 that can be disposed proximate the apertures 186 through which illumination 160 can be delivered. Within this channel 200, the lens 170 can be disposed, such that the lens 170 can be positioned within the channel 200 so that the top surface 202 of the lens 170 is substantially coplanar with an upper surface 204 of the cover portion 184. Accordingly, the lens 170 and cover portion 184 can define the outer shell 94 that has a substantially continuous external surface 206.

In order to secure the lens 170 to the outer shell 94, the lens 170 can include at least one of the tabs 104 that engages a portion of the cover portion 184 proximate the channel 200. Additionally, the lens 170 can also include one of the tabs 104 of the outer shell 94 that engages the tab receptacle 106 of the lighting assembly receptacle 100 of the medial bin divider 44. In this manner, the outer shell 94 and the lens 170 can be independently secured to the lighting assembly receptacle 100 such that both the lens 170 and the outer shell 94 are positioned in a substantially fixed position relative to the medial bin divider 44. Because the lens 170 is independently secured to the medial bin divider 44, there may not be a need for independent adhesives to secure the lens 170 to the cover portion 184 and adhesives may be omitted. Where the lens 170 is substantially transparent, adhesives may show through the lens 170 and diminish the aesthetic appeal of the lighting assembly 48. It is also contemplated that the lens 170 can include separate tabs 104 that directly engage the cover portion 184. The cover portion 184, in turn, can directly engage the lighting assembly receptacle 100 of the medial bin divider 44.

According to the various embodiments, where the lens 170 includes a surface finish that is at least partially translucent, but not transparent, adhesives may be implemented to secure the lens 170 to the cover portion 184. Where the lens 170 is translucent, adhesives may not show through the lens 170 that may detract from the aesthetics of the lighting assembly 48. In various alternate embodiments, the outer shell 94 can be made of a substantially unitary piece that can have various translucent portions 96 and transparent portions that can cooperate to conceal various mechanical portions of the lighting assembly 48 and also allow for the delivery of various illumination 160 from the light fixtures 92 to be delivered to various portions of the refrigerating appliance.

It should be understood that the lighting assembly 48 can be made to encompass an infinite number of configurations to capture various aesthetic details desired by the user of the refrigerated appliance 14. It is contemplated that the lighting assembly 48 can be substantially removable and replaceable where certain vanity-type lighting assemblies can be installed that reflect various user preferences.

Referring again to FIG. 1, it is contemplated that the various embodiments of the lighting assembly 48 can be disposed in alternate portions of the inner door liner 28. Such portions can include a vertical divider 214 within the inner door liner 28, where the lighting assembly 48 can be attached to a portion of the vertical divider 214 so as to appear integral with the vertical divider 214. It is also contemplated that the inner door liner 28 can include the protrusion 62 that extends therefrom, where the protrusion 62 defines an interior volume. Such a protrusion 62 can be distal from a medial bin divider 44 or other divider within the refrigerated appliance 14 and can be configured to be a dedicated light fixture 92 that can provide lighting to various portions of the refrigerated appliance 14. Such a protrusion 62 for providing lighting can be disposed at a top portion 216 of the inner door liner 28 of the appliance door 24, such that lighting can be shed in a downward direction for illuminating various internal portions of a refrigerated appliance 14, or shedding light downward towards the floor surrounding the refrigerated appliance 14. In various alternate embodiments, it is contemplated that the various light fixtures 92 of the lighting assembly 48 can provide the predetermined illumination 160 in a generally upward direction. It is further contemplated that the lighting assembly 48 can be formed as part of a liner integrated lighting system 10 that can be disposed within the liner of a cabinet as well as the liner of the appliance door 24.

According to the various embodiments, the lighting assembly 48 can be made of any one of various materials that can include, but are not limited to, glass, plastic, metal, composite, combinations thereof, and other similar substantially rigid materials that can be used within a refrigerated appliance 14.

The invention claimed is:

1. An integrated lighting system for a kitchen appliance, the integrated lighting system comprising:

a refrigerated appliance having a cabinet structure including a plurality of sidewalls and a back wall that define an interior compartment;

an appliance door coupled to the cabinet structure and operable between open and closed positions, the appliance door including an inner door liner, an outer door wrapper and an insulation layer disposed within a cavity defined between the inner door liner and the outer door wrapper, the inner door liner having a compartment surface that defines at least one bin receptacle;

a bin selectively received by a corresponding bin receptacle of the at least one bin receptacle, the corresponding bin receptacle including a bin divider defined by the inner door liner and extending away from the outer door wrapper, wherein the bin divider cooperates with the bin to define sub compartments of the bin when the bin is coupled to the corresponding bin receptacle; and a lighting assembly coupled to the bin divider, wherein the lighting assembly is configured to selectively illuminate the bin when received by the corresponding bin receptacle and at least a portion of the interior compartment when the appliance door is in the open position.

2. The integrated lighting system of claim 1, wherein the bin divider includes an outer wall that defines a divider inner volume, and wherein the insulation layer extends at least partially into the divider inner volume.

3. The integrated lighting system of claim 2, wherein the lighting assembly includes at least one light fixture attached to an outer shell that is disposed over the at least one light fixture, wherein the outer shell includes an at least partially translucent and not opaque portion that is selectively illuminated when the at least one light fixture is activated, and wherein the outer shell includes a fastening portion that selectively engages the outer wall of the bin divider.

4. The integrated lighting system of claim 1, wherein the lighting assembly includes a plurality of light fixtures, and wherein the plurality of light fixtures provides illumination of at least two lighting colors.

5. The integrated lighting system of claim 3, wherein the at least one light fixture is a light emitting diode included within a circuit board.

6. The integrated lighting system of claim 4, wherein the lighting assembly is coupled to a power source and a control that is configured to deliver electrical current from the power source to the lighting assembly based upon a selected input delivered to the control, and wherein the illumination of the at least two lighting colors is selectively activated based upon the selected input delivered to the control.

7. The integrated lighting system of claim 6, wherein the selected input delivered to the control includes at least one of a temperature of an area proximate the refrigerated appliance, a time of day, a randomized color sequence, a predetermined color sequence, a length of time that the appliance door has continuously been in the open position, a system signal from the refrigerated appliance and a user input.

8. The integrated lighting system of claim 6, wherein the appliance door includes at least one hinge that extends to the cabinet structure to hingedly couple the appliance door to the cabinet structure, wherein the power source for the lighting assembly is disposed distal from the appliance door, wherein electrical current is delivered to the lighting assembly through at least one wire that is run through at least a portion of the cabinet structure and through a hollow door hinge harness disposed within the at least one hinge, and wherein the at least one wire extends from the hollow door hinge harness to a grommet disposed within a portion of the bin divider.

9. An integrated lighting system for an appliance door, the integrated lighting system comprising:

a door inner liner;

an outer door wrapper coupled to the door inner liner to define a cavity, and an insulation layer disposed therein;

a bin selectively received by a corresponding bin receptacle, the corresponding bin receptacle including a bin divider defined by the door inner liner and extending away from the outer door wrapper, wherein the bin divider cooperates with the bin to define sub compartments of the bin when the bin is coupled to the corresponding bin receptacle;

a lighting assembly coupled to the bin divider, wherein the lighting assembly is configured to selectively deliver a predetermined illumination to at least a portion of the corresponding bin receptacle wherein the bin divider includes a grommet, and wherein the lighting assembly includes at least one wire that extends through the grommet, wherein the grommet prevents lateral movement of the at least one wire proximate the lighting assembly, wherein the at least one wire is configured to extend to a power source; and an outer shell portion that supports the lighting assembly, the outer shell portion including a fastening portion that couples the lighting assembly to the door inner liner at the bin divider.

10. The integrated lighting system of claim 9, wherein the lighting assembly includes at least one light fixture that provides the predetermined illumination, the at least one light fixture disposed within the outer shell portion, and wherein the outer shell portion includes an at least partially transparent portion that allows delivery of the predetermined illumination from the at least one light fixture to at least the corresponding bin receptacle.

11. The integrated lighting system of claim 10, wherein the at least one light fixture includes a plurality of light emitting diode fixtures coupled to the outer shell portion and positioned below the at least partially transparent portion, wherein the at least partially transparent portion is a lens that includes a fastening portion that couples the lens to the outer shell portion.

12. The integrated lighting system of claim 10, wherein the at least one light fixture includes a plurality of light fixtures, and wherein the plurality of light fixtures selectively operate to provide the predetermined illumination, wherein the predetermined illumination includes at least two different visible wavelengths of illumination.

13. The integrated lighting system of claim 12, wherein the lighting assembly is coupled to a power source and a control that is configured to deliver electrical current from the power source to the lighting assembly based upon a selected input delivered to the control, and wherein the predetermined illumination is selectively activated based upon the selected input delivered to the control.

14. The integrated lighting system of claim 13, wherein the selected input delivered to the control includes at least one of a temperature of an area proximate the appliance door, a time of day, a randomized color sequence, a predetermined color sequence, a length of time that the appliance door has continuously been in the open position, a system signal from the refrigerated appliance and a user input.

15. An appliance comprising:

a cabinet structure including a plurality of sidewalls and a back wall that define an interior compartment;

an appliance door operably coupled with the cabinet structure and operable between open and closed positions;

a door inner liner having a protrusion extending therefrom, the protrusion defining an interior volume, the door inner liner and the protrusion at least partially defining the interior compartment when the appliance door is in the closed position;

an outer door wrapper coupled to the door inner liner to define a door cavity, the door cavity in communication with the interior volume of the protrusion;

an insulation layer disposed within the door cavity, wherein the insulation layer extends into at least a portion of the interior volume;

a lighting assembly coupled to the protrusion, wherein the lighting assembly is configured to selectively deliver a predetermined illumination to at least a portion of the door inner liner and at least a portion of the interior compartment; and an outer shell that supports the lighting assembly, the outer shell including a fastening portion that couples the lighting assembly to the door inner liner at the protrusion.

16. The appliance of claim 15, wherein the protrusion includes a grommet, and wherein the lighting assembly includes at least one wire that extends through the grommet, wherein the grommet laterally secures the at least one wire proximate the lighting assembly, wherein the at least one wire is configured to extend to a power source.

17. The appliance of claim 15, wherein the lighting assembly includes a plurality of light fixtures, and wherein the plurality of light fixtures selectively operate to provide the predetermined illumination, wherein the predetermined illumination includes at least two different visible wavelengths of illumination.

18. The appliance of claim 17, wherein the plurality of light fixtures are configured to provide the predetermined illumination in a generally upward direction.

19. The appliance of claim 15, wherein the door inner liner includes a bin receptacle configured to receive a bin, and wherein the protrusion defines a bin divider of the bin receptacle, and wherein the bin divider cooperates with the bin to define sub compartments of the bin when the bin is coupled to the bin receptacle.

* * * * *